United States Patent [19]

Prabhu et al.

[11] Patent Number: 4,479,890

[45] Date of Patent: Oct. 30, 1984

[54] THICK FILM RESISTOR INKS

[75] Inventors: Ashok N. Prabhu, Plainsboro, N.J.; Simon M. Boardman, Holland, Pa.

[73] Assignee: RCA Corporation, New York, N.Y.

[21] Appl. No.: 432,973

[22] Filed: Oct. 5, 1982

[51] Int. Cl.[3] ..... H01B 1/06

[52] U.S. Cl. ..... 252/508; 252/511; 106/1.12; 106/20; 524/437; 523/440; 523/457; 523/468; 427/386; 427/96

[58] Field of Search ..... 252/508, 511; 106/1.12, 106/20; 524/437; 523/400, 440, 457, 468; 427/385.5, 386, 58, 96, 126.4; 29/825, 854, 857

[56] References Cited

U.S. PATENT DOCUMENTS

| | | | |
|---|---|---|---|
| 2,795,680 | 6/1957 | Peck | 261/63 |
| 3,648,364 | 3/1972 | Endo | 29/620 |
| 3,896,406 | 7/1975 | Anderson et al. | 252/511 |
| 3,956,195 | 5/1976 | Izmailovich et al. | 252/511 |
| 3,998,779 | 12/1976 | Baer | 252/512 |

OTHER PUBLICATIONS

Inagaki, *Journal of Electronic Engineering*, Apr., 1980, pp. 38 and 39.

Sargent, *Electronic Packaging and Production*, Sep., 1981, pp. 65–75.

Fu et al., *IEEE Transactions On Components, Hybrids, and Manufacturing Technology*, vol. CHMT-4, No. 3, pp. 283–288, (Pt. I) and pp. 289–293 (Pt. II).

*Primary Examiner*—Josephine L. Barr

*Attorney, Agent, or Firm*—Birgit E. Morris; R. Hain Swope

[57] ABSTRACT

An improved ink composition suitable for the formation of thick film resistor inks which can be terminated directly to copper foil conductors. The subject compositions comprise an epoxy resin, conductive carbon particles, a suitable solvent and particulate alumina, wherein the alumina is present in an amount at least equal to the resin content on a weight basis.

10 Claims, No Drawings

THICK FILM RESISTOR INKS

This invention relates to ink compositions suitable for the formation of thick film resistors on printed circuit boards. The subject inks are of significant advantage in that they may be terminated directly to copper foil conductors.

BACKGROUND OF THE INVENTION

The use of resin ink compositions to form thick film resistors on printed circuit boards is well known in the art. Such compositions are described, for example, in U.S. Pat. Nos. 3,648,364 and 2,795,680.

Resin ink compositions for thick film resistors are conventionally comprised of a resin, usually an epoxy resin or a modified epoxy resin, conductive particles, usually carbon and/or graphite, and a suitable organic solvent. U.S. Pat. No. 2,795,680 discloses such compositions which may contain up to about 25% by weight of finely divided nonconductive materials, including alumina.

Heretofore, it has been necessary to utilize an intermediate pad of a conductive material, e.g. silver, between copper foil conductors and the thick film resistors formed from inks such as described above. The use of intermediate pads is required because resistors formed from such conventional ink compositions are unstable when terminated directly to copper foil and will often begin to deteriorate in use within a matter of hours. This instability, in all probability, is due to the large difference in the thermal coefficient of expansion between the resistors and both the copper foil and the x-y axis of the printed circuit board. Resistors formed from conventional inks also frequently adhere poorly when bonded directly to copper foil conductors.

The use of an intermediate pad of, e.g. silver, usually solves the problems of instability and poor adhesion experienced with resistors formed from conventional thick film inks. However, in addition to the added cost of the silver, the use of such intermediate pads requires the time and cost of formulating appropriate epoxy compositions which must be applied and cured on the circuit board before the resistor film is applied.

It would be desirable to have thick film resistor ink compositions which can be terminated directly to copper foil conductors without the use of silver intermediate pads. In addition, it would be desirable to have thick film resistors which have superior power dissipation capacity than previously known formulations, whether terminated directly to copper foil or connected thereto via silver intermediate pads.

SUMMARY OF THE INVENTION

The improved thick film inks provided in accordance with this invention comprise conductive carbon particles, finely divided alumina, an epoxy resin and a suitable solvent, wherein the amount of alumina present is at least equal to the amount of epoxy resin present.

DETAILED DESCRIPTION OF THE INVENTION

In accordance with this invention, there are provided improved thick film resistor inks which can be terminated directly to copper foil conductors on printed circuit boards. Films formed from the subject inks demonstrate superior heat dissipation capacity and possess an exceptional stability and compatibility of the bond both to the copper foil and to conventional circuit boards. Because films formed from the subject inks are not stressed, they will form a bond directly to copper foil which will remain stable, even conditions of high humidity. In constrast, bonds between films formed from commercially available inks and copper foil will not remain stable because stresses in the film lead to breaks in the copper/resistor bond at the interface which significantly increases resistance.

The superior characteristics of films formed from the subject inks are the result of the fact that the content of alumina particles therein is at least equal to the amount of epoxy resin present. It has been found that at least about 30 percent by weight of alumina particles is required in the subject inks to achieve the desirable properties enumerated above. More particularly, the subject ink compositions contain from about 30 to about 40, preferably about 35, percent by weight of alumina particles.

The alumina, i.e. aluminum oxide, utilized in the subject inks preferably has an average particle size of about one micrometer. Alumina having an average particle size substantially below about one micrometer is not well suited for the subject inks. For example, the porosity of films formed from inks containing alumina having an average particle size of about 0.5 micrometer and below has a negative effect on the usefulness of such films. Further, the average particle size of the alumina should not exceed about five micrometers in order for the ink to have requisite physical properties, e.g. proper rheology.

In addition to the high percentage of alumina of a particular size range, it is important that the alumina content of the subject inks is at least about equal to, and preferably exceeds, the amount of the epoxy resin present. Specifically, the ratio of particulate alumina to the resin should be from 1:1 to about 2:1, preferably about 1.4:1, on a weight basis. These criteria of weight percent, particle size and weight ratio are all critical to the advantageous properties of the subject inks and the thick film resistors formed therefrom.

The resin component of the subject thick film ink compositions can be any epoxy resin recognized as being useful in such formulations. Such resins should be curable at low temperatures, i.e. 125°–250° C., preferably in either air or an inert atmosphere such as nitrogen, have a good shelf life and be compatible with both the carbon black and the substrate being coated. Suitable epoxy resins are preferably bisphenol A based epoxy resins. Conventional modified epoxy resins, i.e., epoxy resins containing one or more additional resins such as urea-formaldehyde resins, are also useful in this invention. A particularly preferred epoxy resin for the ink compositions of this invention is a modified epichlorohydrin-bisphenol A epoxy resin containing a urea-formaldehyde resin available under the trademark Unipoxy 800 from Advance Excello Color and Chemical Division, Chicago, Ill. The ink compositions of this invention contain from about 20 to about 30, preferably from about 23 to about 25, percent by weight of the epoxy resin.

The conductive carbon component of the subject compositions can be any highly electrically conductive carbon, such as carbon black, graphite and the like, preferably one having a low bulk density. A presently preferred material is a carbon black marketed by Akzo Chemie under the trademark Ketjenblack EC. This material has an apparent bulk density of 150 grams per liter and an average particle size of about 300 angstroms. Other conductive carbon materials having similar properties such as the conductive carbon blacks available from the Cabot Corporation may likewise be utilized in the subject compositions. The subject compositions contain from about 0.5 to about 10, preferably from about 1 to about 3, percent by weight of conductive carbon black.

The subject ink compositions further contain a suitable solvent. Such solvents are compatible with the other components and have a boiling point below the curing temperature of the ink composition. Suitable solvents include, for example, cellosolve, i.e. 2-ethoxyethanol, butyl carbitol, i.e. diethyleneglycol monobutyl ether, isophorone, i.e. 3,5,5-trimethyl-2-cyclohexen-1-one, butyl carbitol acetate and the like. Generally, the solvent comprises from about 25 to about 50, preferably from about 35 to about 40, percent by weight of the subject ink compositions. The ink compositions of this invention may, if desired, contain conventional additives such as colorants, surfactants and the like in their usual amounts.

The subject ink compositions are prepared in a known manner by combining the ingredients in a suitable mixing apparatus. The subject inks are then applied to a substrate, i.e. a circuit board, by conventional means, preferably by screen printing. The inks are cured, preferably in an inert atmosphere such as nitrogen, at a temperature of from about 100° to about 250° C. for from 15 to 120 minutes. If the subject inks are terminated to a silver intermediate pad, they may be cured in air. It is of significant advantage that the subject ink compositions can be terminated directly to a copper foil conductor without the requirement of an intermediate pad of a material such as silver.

The following Examples further illustrate this invention, it being understood that the invention is not intended to be limited to the details described therein. In the Examples, all parts and percentages are on a weight basis and all temperatures are in degrees Celsius, unless otherwise stated.

EXAMPLE 1

Thick film resistor inks were prepared by thoroughly blending the following compositions into a smooth paste suitable for screen printing. The inks were prepared on a three roll mill at ambient temperature.

| Ingredient | Formulation (Percent by Weight) | | | |
|---|---|---|---|---|
| | A | B | C | D |
| Carbon Black | 2.6 | 1.8 | 1.4 | 1.3 |
| Epoxy Resin | 46.1 | 31.8 | 24.6 | 23.0 |
| Alumina | — | 27.3 | 35.2 | 39.5 |
| Added Solvent | 5.3 | 7.3 | 14.2 | 13.2 |
| Total Solvent | 51.3 | 39.1 | 38.8 | 36.2 |
| Weight Ratio of Alumina to Resin | — | 0.9:1 | 1.4:1 | 1.7:1 |

In the above formulations, the carbon black was Ketjenblack EC, Akzo Chemie, and the alumina was Linde Alumina, Union Carbide Chemical Corp., average particle size 1.0 micrometer. The epoxy resin was an epichlorohydrin-bisphenol A condensate modified with an urea-formaldehyde resin, Unipoxy 800, Advance Excello Color and Chemical Division. The resin was utilized premixed with approximately fifty percent solvent as supplied by the manufacturer. The solvent was a mixture of cellosolve, isophorone and butyl carbitol acetate in the ratio 16:12:28. The solvent added to assure the proper rheology of the inks was T-974, Advance Excello Color and Chemical Division, which is recommended for Unipoxy 800 and which was the same or a similar mixture as the solvent therein.

The inks were screen printed on circuit boards containing etched copper foil conductors. For each ink formulation, printings were made directly to the copper foil and to copper foil on which had been cured a silver intermediate pad. The inks were cured in nitrogen at a peak temperature of 200° in a belt furnace. The time the inks were at the peak temperature was about 20 minutes. The sheet resistance of the films are given in Table I.

TABLE I

| Formulation No. | Sheet Resistance (KΩ/□) | |
|---|---|---|
| | Ag Termination | Cu Termination |
| A | 10.9 | 22.8 |
| B | 12.1 | 25.3 |
| C | 16.2 | 28.8 |
| D | 18.5 | 30.0 |

It would be expected from U.S. Pat. No. 2,795,680 that the high alumina content of the subject inks would significantly increase the sheet resistance of films formed therefrom because the alumina creates discontinuities in the conduction path of the film. It can be seen from the data in Table I, however, that such is not the case. For example, even though there is a fifty percent reduction in carbon content from formulation A to formulation D, there is little change in the sheet resistance in spite of the alumina content increasing from zero to about 40 percent. It is therefore apparent that the critical ratio is between the carbon black and the epoxy resin, since these are the same in formulations A and D.

Inks were prepared from the following formualtions:

| Ingredient | Formulation (Percent by Weight) | |
|---|---|---|
| | E | F |
| Carbon Black | 6.7 | .9 |
| Epoxy Resin | 23.3 | 24.8 |
| Alumina | 33.3 | 35.3 |
| Added Solvent | 13.4 | 14.2 |
| Total Solvent | 36.7 | 39.0 |

These inks were formed into films and the sheet resistance determined as above. The results are reported in Table II.

TABLE II

| Formulation No. | Sheet Resistance (KΩ/□) | |
|---|---|---|
| | Ag Termination | Cu Termination |
| E | 0.99 | 0.80 |
| F | 355 | 659 |

It can be seen from the data in Table II that the sheet resistance of films formed from the subject inks can be widely varied simply by changing the ratio of carbon black to epoxy resin. Because changes in the alumina content of the ink do not have a substantial effect on the sheet resistance of the films, the ratio of alumina to resin can be maintained at optimum levels. Therefore, the compatibility of the bond to copper and other advantageous properties of films formed from the subject inks can be maintained over a broad spectrum of sheet resistance capacities. This is a further advantage of the subject inks.

EXAMPLE 2

Samples of resistor films formed from ink formulation C of Example 1, bonded directly to copper foil and to a silver intermediate pad, respectively, were tested for long term stability. Formulation C contained 35.2 percent alumina and had a weight ratio alumina to resin of 1.4 to 1. Samples were stored for 1000 hours at ambient temperature, at 50° and power loaded, 5 watts/square inch, at 50°, respectively. Under all conditions, the resistors demonstrated a sheet resistance change of less than 1 percent, which is considered very good. Tested under similar conditions, films of formulation A of Example 1, which contained no alumina, showed comparable stability when bonded to a silver intermediate pad. However, when bonded directly to copper foil, all samples showed a deterioration in excess of 16 percent under all conditions. This change in resistance is considered unacceptable.

EXAMPLE 3

In order to study the effect of humidity on stability, resistor films of Formulation C of Example 1 (35 percent alumina) were tested at 85 percent relative humidity, 50° for 2 hours. Samples terminated directly to copper foil showed an increase in sheet resistivity of only about 3 percent whereas films of formulation A, which contained no alumina, showed an increase in sheet resistivity of about 13 percent. A carbon containing resistor ink commercially available from Electro Science Laboratories, Pennsauken, N.J., prepared according to manufacturer's directions and tested under similar conditions, showed an increase of 25 percent. The manufacturer specifically recommends that this ink be terminated only to silver and not directly to copper foil.

Films of formulation A (no alumina) bonded to a silver intermediate pad and tested under similar conditions showed an increase in sheet resistivity of only about 2 percent at high humidity whereas the Electro Science Laboratory Resistor film bonded to silver showed an increase of 10 percent under the same conditions.

EXAMPLE 4

In order to study the effect that alumina concentration and the weight ratio of alumina to resin have on stability, samples of formulations B (27 percent alumina, 0.9:1 ratio), C (35 percent alumina, 1.4:1 ratio) and D (39.5 percent alumina, 1.7:1 ratio) were screen printed and cured on copper foil terminations directly and with intermediate silver pads. The samples were stored for 750 hours at room temperature, after which sheet resistance was determined. The increase in sheet resistance for Formulation B was less than one percent terminated to silver and about two percent terminated to copper. Formulation D showed a decrease of slightly above one percent terminated to silver and less than one percent terminated to copper. Formulation C showed an increase of less than one percent when terminated to silver or directly to copper. These data indicate that both Formulations C and D are suitable when terminated directly to copper, but that Formulation C is the optimum formulation for all applications.

We claim:

1. In a process of terminating a thick film resistor to a copper foil conductor on a circuit board comprising:

(a) applying directly to selected sites on the copper conductor a thick film resistor ink composition comprising an epoxy resin, alumina conductive carbon particles and a suitable solvent; and (b) curing the ink composition by heating to a temperature between about 100° and 250° for from 15 to 120 minutes thereby forming a thick film resistor, the improvement wherein said ink composition contains particulate alumina having an average particle size of from above about 0.5 micrometer to about 5.0 micrometers, and the weight percent ratio of the particulate alumina to the epoxy resin is between about 1:1 and about 2:1.

2. A process in accordance with claim 1, wherein said ink comprises from about 20 to about 30 percent by weight of the epoxy resin; from about 30 to about 40 percent by weight of particulate alumina; from about 1 to about 7 percent by weight of particulate conductive carbon black; and from about 25 to about 50 percent by weight of a suitable solvent.

3. A process in accordance with claim 2, wherein said ink composition comprises: from about 23 to about 25 percent by weight of the epoxy resin; about 35 percent by weight of alumina; from about 1 to about 3 percent by weight of carbon black and from about 35 to about 40 percent by weight of the solvent.

4. A process in accordance with claim 1, wherein the particulate alumina has an average particle size of about one micrometer.

5. A process in accordance with claim 1, wherein the ratio in weight percent of alumina to the resin is about 1.4:1.

6. A process in accordance with claim 1, wherein the epoxy resin is a modified bisphenol A resin.

7. A process in accordance with claim 6, wherein said resin is an epichlorohydrin-bisphenol A resin containing an urea-formaldehyde resin.

8. In an ink composition suitable for forming a thick film resistor on a circuit board comprising an epoxy resin, conductive particles and a suitable solvent, the improvement wherein said ink contains a sufficient amount of particulate alumina having an average particle size of from above about 0.5 micrometer to about 5.0 micrometers so that the ink can be applied directly to a copper foil conductor on the board, the weight ratio of the alumina to the epoxy resin being between about 1:1 and 1:2, said ink comprising: from about 20 to about 30 percent by weight of said resin; from about 30 to about 40 percent by weight of the alumina, from about 1 to about 7 percent by weight of conductive carbon particle and from about 25 to about 50 percent by weight of a suitable solvent.

9. An ink composition in accordance with claim 8, wherein said composition comprises from about 23 to about 25 percent by weight of the epoxy resin; about 35 percent by weight of alumina; from about 1 to about 3 percent by weight of carbon black and from about 35 to about 40 percent by weight of the solvent.

10. An ink composition in accordance with claim 8, wherein the particulate alumina has an average particle size of about one micrometer.

* * * * *